United States Patent [19]

Hoffa

[11] 4,093,236

[45] June 6, 1978

[54] WAR GAME APPARATUS

[76] Inventor: Randy Lee Hoffa, 8000 E. River Rd., Minneapolis, Minn. 55432

[21] Appl. No.: 743,976

[22] Filed: Nov. 22, 1976

[51] Int. Cl.[2] ..... A63F 3/00

[52] U.S. Cl. ..... 273/255; 273/262; 273/283

[58] Field of Search ..... 273/131, 134, 131 BB, 273/131 F, 134 AC, 134 D

[56] References Cited

U.S. PATENT DOCUMENTS

| | | | |
|---|---|---|---|
| 1,160,348 | 11/1915 | Watkins | 273/131 BB |
| 3,823,943 | 7/1974 | Chamecki | 273/131 BB X |

FOREIGN PATENT DOCUMENTS

| | | | |
|---|---|---|---|
| 1,185,805 | 3/1970 | United Kingdom | 273/134 AC |

*Primary Examiner*—Richard C. Pinkham
*Assistant Examiner*—Harry G. Strappello

[57] ABSTRACT

A tactical war game and method for playing same featuring a multipart geomorphic playing board and detailed 1/285 scale vehicles or weapons in which each particular game piece has performance data established for it and the play of the game involves maneuvering and imaginary exchange of fire between the opposing game pieces utilizing this performance data.

2 Claims, 4 Drawing Figures

WAR GAME APPARATUS

BACKGROUND OF THE INVENTION

1. Field of the Invention

This invention relates generally to tactical games which are played upon a board using movable pieces to represent instruments of warfare, and more particularly to a game utilizing a geomorphic multiple piece game board and accurately scaled miniatures of tanks, guns, or ships for which performance data is established and which are moved upon the board according to the method of playing the game with restrictions imposed by the performance data established for each vehicle or vessel.

2. Description of the Prior Art

Board games emphasizing strategy as compared to tactics between game board pieces which are moved by the opponents or players of the game are very old. The game of chess is perhaps the oldest and most widely known strategy game wherein limitations are placed on the movement of certain pieces and the opponents's pieces are captured according to certain rules. Board games attempting to simulate warfare have for the most part employed rules involving chance such as the game of Battleship in which the position of the opponent's board pieces are not disclosed and "shots" are directed to specified areas with the hope that the opponent's piece will be positioned in that hidden square and destroyed. There is a need for a game which is adapted to realistically simulate the tactical aspects of warfare.

SUMMARY OF THE INVENTION

A game consisting of a multiple part geomorphic game board having various types of terrain or obstacles or navigational hazards designated thereon with an overlying grid of hexagons on which accurately scaled three dimensional miniature game pieces visually identifiable as combat vehicles, weapons, or vessels are moved and maneuvered. Performance data established for each of these pieces is used to determine the mobility and maneuvering characteristics as well as the fire power and ability to withstand imaginary hits by opponent's pieces during the play of the game.

DETAILED DESCRIPTION OF THE PREFERRED EMBODIMENT

Figure 1:
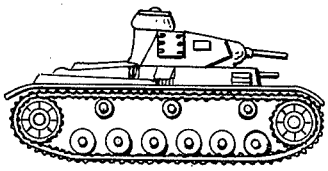
FIG. 1 is a perspective view of a miniature battle tank to be used as a game piece in a game embodying the present invention.
Figure 2:
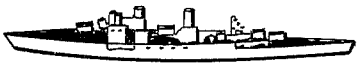
FIG. 2 is a perspective view of a typical miniature warship which could be used in a board game embodying the present invention.
Figure 3:
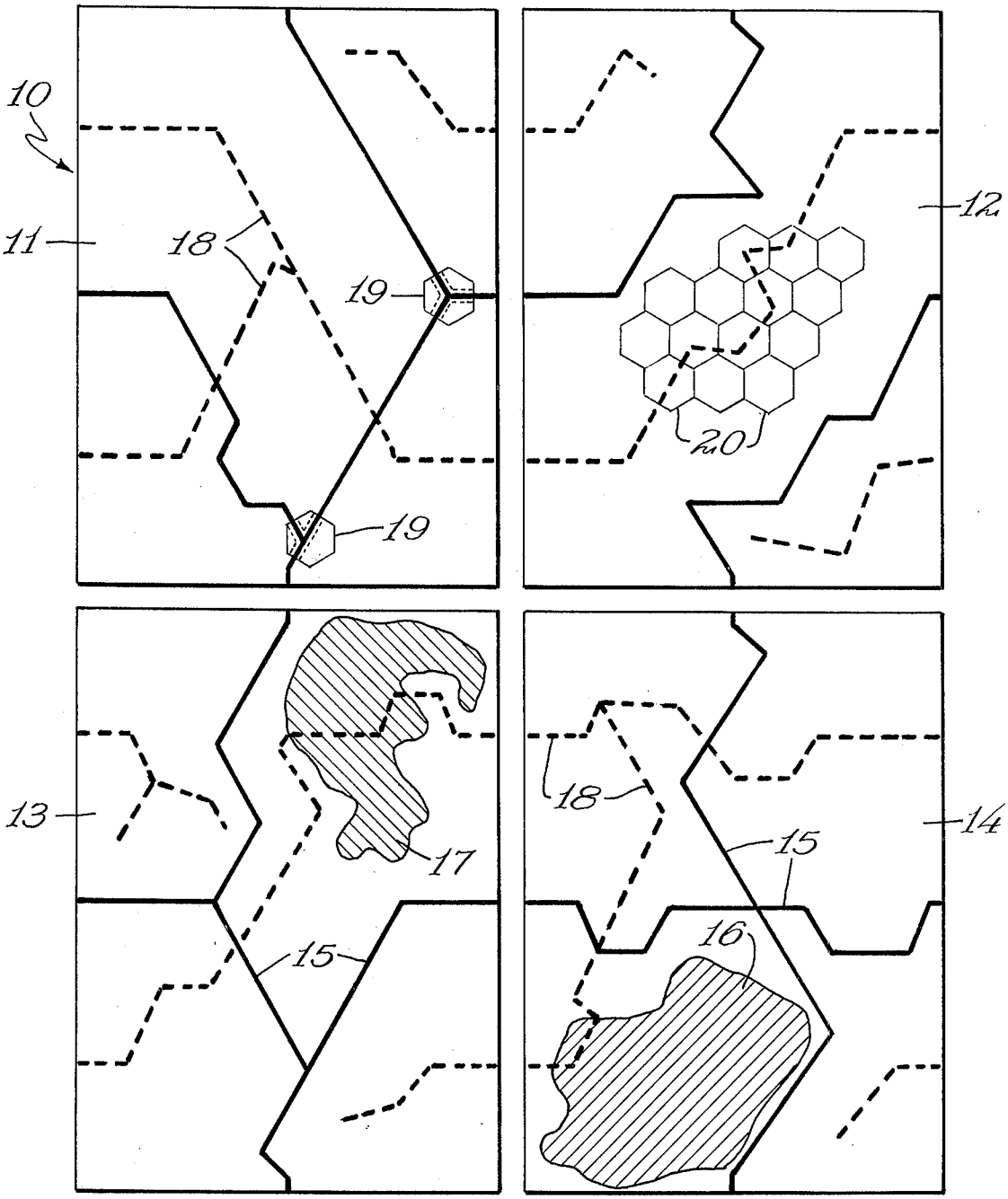
FIG. 3 is a plan view of a four part geomorphic game board adapted for use in playing a game embodying the present invention.
Figure 4:
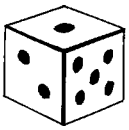
FIG. 4 is a perspective view of a die which could be used in playing a game embodying the present invention.

The game is played using a game board 10 which in the preferred embodiment is of a geomorphic design consisting of four rectangular portions 11, 12, 13 and 14 which have printed thereon in dark narrow lines a grid 20 consisting of hexagons of much the same appearance as a honeycomb grid. For convenience in this specification, these hexagonal areas will be referred to as spaces on the board. In addition, there is printed on the board 10 a variety of types of terrain and other obstacles for use when playing the game as a land war strategy game. The heavy dark lines 15 indicate a pattern of roadways and it is this pattern of roadways which is printed in a manner so that the four sections of the game board may be rearranged to increase the number of geographical situations and give the players a different terrain on which to operate each time the game is played.

In the preferred embodiment colors are used to define different types of terrain or navigational obstacles. For example the area designated 16 could be colored orange and represent an area of high ground. The area 17 could be colored dark green and represent forested land. The dashed lines 18 could be solid blue lines and represent rivers or streams. The portions of the roads 15 bordered by dashed lines 19 represent towns. Although it is not illustrated, a similar game board for naval vessels could use different shades of blue to represent different channel depths and land masses as obstacles to navigation.

Each of the players is allocated or selects one or more vehicles, anti-tank guns, or vessels with which to play. The game pieces are highly detailed and scaled three dimensional miniatures in a 1/285 reduction of actual battle tanks or ships which have been used in modern warfare. It is important that accurately scaled models which are visually identifiable be utilized since that adds to the realism of the game and also effects the method of play as will be described later.

Vehicle, vessel, and weapon performance data is provided for each piece and includes a numerical movement factor, which is a number indicating how many spaces on the board may be traversed by a piece on a given turn. A schedule of numerical reduction factors is included for the various types of terrain which appear on the game board and these reduce the number of spaces which a piece may move on a given turn by simple subtraction. For example, if a tank has a movement factor of 6, and is moving across wooded areas with a terrain factor of 2, then in that terrain the vehicle would only be able to move 4 spaces. In the preferred embodiment, if more than one type of terrain appears on a given space of the game board, the terrain factors for each different type of terrain are added together and the totals subtracted from the movement factor of a given piece. It is possible that a given piece may not move at all in a given type of terrain. In addition, each piece has assigned to it a mobility factor which means that for each space through which the piece moves it may be deviated from its course one 60° turn, or one face of the hexagon space on which it is resting, the mobility factor being the total number of changes of direction allowed during a given move. The player may utilize any remaining mobility factor units after the movement is completed by turning the particular piece within the space on which it rests.

For weapons which fire, the number of rounds of ammunition which are available to the player for use with that weapon are specified.

Method of Play

There are two basic methods or systems for playing the game, the first being designated the simultaneous system. In this system a first player records initial movements of his pieces on a separate map pad which is a small reference pad printed with the same terrain contour as the game board. These initially plotted moves are not disclosed to the opponent, and the second player or players then move their pieces onto the game board. The first player then places his pieces in position on the board as they were initially recorded on the map pad, and if it is possible for firing to take place between the opponents, it is considered as occuring simultaneously. The results are then evaluated to determine if any hits have been scored and any pieces or guns put out of commission. This same procedure may then be then repeated, or the players may then take turns moving from their positions with each player being allowed to move alternatively, and with simultaneous firing occuring after each set of moves.

The sequential system of play is similar, and provides that both players take up initial positions on the board with their pieces, and then make alternate moves with simultaneous fire after each set of moves. The object is to destroy by weapon's fire all of the opponent's tanks or vessels or guns.

In addition to the movement and mobility data for each vehicle or vessel, there is also information relating to the fire power, armor or defensive capability, and the ability of the particular guns mounted on that vehicle (or vessel) to penetrate the armor of the opponent. As can be seen in the sample fire power table, for tanks, if the range from the vehicle which is firing to the target vehicle is from 1 to 5, then the player is allowed to roll the die three times, and each time the number on the die comes up an odd number, a hit is considered to have been scored. It can be seen that the likelihood of scoring a hit decreases as the distance to the target vehicle increases and when the distance is 16 to 20 spaces, only two possible numbers on the die will be considered as hits on the target vehicle, from 21 to 25 spaces only a roll of 1 will be considered a hit, and the weapon for tank A does not have the ability to hit a target beyond 21 spaces.

Once it is determined how many hits have been scored, there must then be a comparison made between the armor penetration data for the gun which is being fired and the armor resistance ratings for the target vehicle or vessel. A different rating is given for the front, rear, and sides of the vehicle and an example is given below. Similarly, depending on the range in spaces between the firing vehicle and the target vehicle, a number representing armor penetration is given for each offensive weapon. These numbers are compared and if the armor penetration number is less than the armour resistance number, the particular round is considered to have done no damage. If the numbers are equal then the player who is considered to have fired the shot is allowed one throw of the die and if the number resulting is a 1 or a 2 the target is considered to have been destroyed. If the armor penetration number is one greater than the armor resistance number, then a single throw of the die is allowed and a score of 1 through 4 will be considered adequate to have destroyed the target. If the armor penetration number is two or more greater than the armor resistance number for the side of the vehicle which is being shot at, then the target is considered to have been knocked out. Example: Tank B shoots at tank A from a distance of 7 spaces.

RATE OF FIRE TABLE

| Vehicle | Gun | Range in Spaces 1–5 | 6–10 | 11–15 | 16–20 | 21–25 | 26–30 |
|---|---|---|---|---|---|---|---|
| A | 76.2mm L/30.5 | 2(odds) | 1(1–4) | 1(1–2) | 1(1) | 0 | 0 |
| B | 85mm | 4(odds) | 3(odds) | 2(odds) | 1(1–4) | 1(odds) | 1(1–2) |

VEHICLE DATA CHART

| Vehicle | Gun | Mov.Fac. | Mob.Fac. | Armor Front/ Back/ Side | Rounds |
|---|---|---|---|---|---|
| A | (76.2mm) L/30.5 | 11 | 6 | 5/4/4 | 20 |
| B | (85mm) | 11 | 6 | 6/5/5 | 9 |

ARMOR PENETRATION

| Vehicle | Weapon | Range in Spaces 1 | 2–5 | 6–10 | 11–15 | 16–20 | 21–25 | 26–30 |
|---|---|---|---|---|---|---|---|---|
| A | (76.2mm) L/30.5 | 3 | 3 | 2 | 2 | 2 | 1 | |
| B | (85mm) | 6 | 6 | 5 | 5 | 4 | 4 | 3 |

Rate of fire table indicates 3 throws of die at a range of 7 spaces, with odd numbers on the die representing hits. Player B rolls three times and has only one odd number. A single hit is scored. Assuming the hit is on the side of the tank A from a shot by tank B at 7 spaces, the penetration number is 5 and the armor number is 4. A single throw of the die by player B is taken and a score of 1 through 4 indicates the tank A is destroyed.

It should be noted that the vehicle or gun which is firing must remain stationary while it is firing or the likelihood of striking the target as determined by the rate of fire table is reduced by one half where the movement was two spaces or less, and firing is not permitted "on the run", which is considered to be a movement of more than two spaces. Similarly, if the target is moving more than four spaces, the number of rolls of the die as dictated by the rate of fire table are cut in half, or rounded off in favor of the target vehicle or vessel.

Where the tank or ship has turret mounted weapons the turrets may be turned after the piece is moved according to the following schedule. If the vehicle data indicates that the weapon is larger than 88 mm — a movement of 60° is permitted. If the weapon is between 51 mm and 88 mm — a movement of 120° is permitted. Turreted pieces with weapons of less than 51 mm may move the turrets, 180°, but it should be noted that the turret must remain in the same position relative to the hull during the next move. For weapons which are not mounted on rotatable turrets, the field of permissable fire is a 60° triangle eminating from the front of the vehicle or weapon.

Since it is important in the play of the game to take full advantage of the performance data of the player's own pieces and exploit the weaknesses in the performance data of the opponent's pieces, it is important to be able to recognize and distinguish the various pieces which are on the board and it is in this sense that the accurate scaling and detailing of the pieces is of value. Failure to recognize the type of vehicle or vessel may result in a fatal error in tactally moving the pieces which one player controls.

It should be understood that these basic game rules may be employed in a game of naval strategy wherein the game board is provided with such information as land masses, shallow areas where only certain vessels may operate, channel areas which are deeper for larger vessels and of course rates of turn which would be more constricting for larger vessels in constrained areas. The weapons on the ship would be similarly specified as to fire power capabilites and the ship itself would have certain armor penetration resistance factors assigned to it. It is even possible to combine land operations with naval operations should the game board be so designated and prepared.

Additional rules may be utilized in the method of playing the game to enhance the realistic nature of the play such as utilizing ridge lines or destroyed vehicles as hull-down positions. A vehicle may be moved into position with a destroyed vehicle between it and an opponent's vehicle with the resulting situation being that the first vehicle is considered to be hiding or hull-down to the opponent's vehicle and while it may fire with full effect upon the opponent's vehicle, the opponent is considered to have a limited target exposure by virtue of the destroyed vehicle and the hit chances are reduced by one half, rounding off any fractions in the rate of fire table in favor of the target. Similarly, woods or ridge lines blocking the line of sight prevent opposing vehicles from firing at one another. If one vehicle is at the edge of a ridge line and on the top of the ridge it may fire as if in a hull-down position that vehicles more than one space away from the edge of the ridge line, its likelihood of being hit reduced by one half from vehicles more than one space below it and at the lower elevation.

As previously noted, weapons fire is considered to have been simultaneous, and even though the players must take turns determining the effect of the fire from their particular vehicles for weapons, any opposing unit knocked out is still considered to have fired on that turn if the player controlling that board piece wishes it to have fired.

I claim:

1. Tactical warfare game apparatus, comprising:

a game board on which various types of terrain and geography are designated, using color to determine elevation and which is marked with an overlying hexagonal grid pattern;

game pieces comprising accurately scaled three dimensional miniatures of instruments of warfare, said pieces visually distinguishable and identifiable;

first charts with tables printed thereon embodying data pertaining to each respective game piece enabling calculation of information relating to the ability of each said piece to be moved on said board, its firepower, and its resistance to opponents' fire;

second charts with tables printed thereon embodying data pertaining to said various terrain and geography on said board enabling calculation of the ability of each of said pieces to be moved on said various terrain on said board;

a single die; and a worksheet having printed thereon a replica of the features on said game board.

2. The apparatus of claim 1, wherein said pieces comprise miniature battle tanks reproduced in 1/285 scale.

* * * * *